US005960653A

United States Patent [19]

DeWalch et al.

[11] Patent Number: 5,960,653

[45] **Date of Patent: *Oct. 5, 1999**

[54] ADJUSTABLE CLOSURE LOCK

[76] Inventors: Norman Binz DeWalch; Jeffrey Mark Davis, both of 6850 Wynnwood, Houston, Tex. 77008

[ * ] Notice: This patent issued on a continued prosecution application filed under 37 CFR 1.53(d), and is subject to the twenty year patent term provisions of 35 U.S.C. 154(a)(2).

[21] Appl. No.: 08/710,430

[22] Filed: Sep. 17, 1996

[51] Int. Cl.[6] ..... B65D 55/14

[52] U.S. Cl. ..... 70/164; 70/63; 70/232; 70/34; 70/386

[58] Field of Search ..... 70/461, 466, 422, 70/370, 229, 34, 386, 158–173, 208; 411/392, 107, 171; 292/341.18, 341.19

[56] References Cited

U.S. PATENT DOCUMENTS

| | | | |
|---|---|---|---|
| 2,177,996 | 10/1939 | Raymond | 70/386 |
| 2,877,637 | 3/1959 | Greenwald | 70/168 |
| 3,125,873 | 3/1964 | Robinson | 70/63 |
| 3,213,653 | 10/1965 | Probasco | 70/166 |
| 3,550,412 | 12/1970 | Pitel et al. | 292/341.18 X |
| 3,789,638 | 2/1974 | Roberts et al. | 70/366 |
| 3,968,985 | 7/1976 | Nielsen, Jr. et al. | 70/63 X |
| 4,107,959 | 8/1978 | Skarzynski et al. | 70/DIG. 34 X |
| 4,331,012 | 5/1982 | Swisher | 70/166 X |
| 4,391,110 | 7/1983 | Nielsen, Jr. | 70/34 |
| 4,414,829 | 11/1983 | Nielsen, Jr. et al. | 70/DIG. 34 X |
| 4,676,084 | 6/1987 | Signorelli | 70/455 X |
| 4,986,096 | 1/1991 | Soehner et al. | 70/164 X |
| 5,079,935 | 1/1992 | Zaucha | 70/162 X |
| 5,226,302 | 7/1993 | Anderson | 292/341.18 X |

FOREIGN PATENT DOCUMENTS

| | | | |
|---|---|---|---|
| 449281 | 6/1949 | Italy | 70/34 |

*Primary Examiner*—Suzanne Dino Barrett
*Attorney, Agent, or Firm*—Jeffrey M. Davis

[57] ABSTRACT

A door closure for an electric meter box comprises a barrel lock, a lock receiver, a tie rod, a locking nut, and a base plate. The lock includes a shank portion, a head portion, and a flange. The head portion resides in a hole in the meter box door, and the flange captures the outside surface of the door. The lock shank is received by a hole in one end of the lock receiver. The hole has an internal groove for receiving the locking balls in the lock shank. The other end of the lock receiver receives the threaded end of a tie rod. The other end of the tie rod is welded to a base plate, which is screwed into the back of the meter box. The position of the lock receiver can be adjusted to match the depth of the meter box by screwing the receiver up or down on the tie rod. The position of the receiver is then fixed by a lock nut immediately behind the lock receiver. The lock receiver can also be aligned with the door hole by flexing the tie rod.

14 Claims, 9 Drawing Sheets

ADJUSTABLE CLOSURE LOCK

BACKGROUND

1. Field of the Invention

This invention relates to electricity meter boxes, in particular to an adjustable closure for securing the door of the meter box.

2. Problems Addressed by the Invention

In the utility industry, electricity meters are often enclosed in metal meter boxes with hinged metal or Plexiglas doors which allow access to the meter. A great number of these doors are secured only by a latch operated by a simple, low security key. As the incidence of energy theft via meter tampering has increased in recent years, many utility companies have found it necessary to retrofit their meter boxes with high security locks in order to prevent unauthorized access to the meters. The problem with retrofitting a large number of meter boxes is that the boxes tend to vary in shape and size. This requires the locking assembly used to secure the box doors to be customized for each box, making installation potentially expensive and time consuming. Also, the presence of the meter and cables in the box limit the space and surfaces available for mounting the locking assembly.

3. Discussion of Prior Art

In order to provide background information so that the current invention may be understood and appreciated in its proper context, reference is made to a meter box locking assembly in current use. In this assembly, an L-shaped bracket is mounted in the meter box on the bottom or side wall, and a hole in the bracket is aligned with a hole in the door of the box. A bushing having a lower threaded portion, a central flange portion, and an upper thin-walled portion, is inserted threaded end first into the door hole. The flange portion, having a larger diameter than the door hole, abuts the outside surface of the door, and the bushing is secured to the door with a locking nut. The bushing has a central hole with a larger diameter counter bore starting at the thin walled end, and extending almost to the bottom of the threaded portion. The thin-walled section contains several apertures for receiving a security seal like the one shown in U.S. Pat. No. 4,353,583 (1982, Moberg).

When the door is locked, a barrel lock is used, such as the one shown in U.S. Pat. No. 4,742,703 (1988, DeWalch et al.). A barrel lock, as defined in the present disclosure, is commonly characterized as having a generally cylindrical case with a head portion, a smaller diameter shank portion, and a shoulder portion interposed between the head and shank portions. The shank portion includes locking means, usually a pair of retractable steel balls. The smaller diameter shank of the lock passes through the hole in the bushing until the shoulder portion of the lock abuts the bottom of the counter bore. In this position, the locking balls on the shank extend just beyond the hole in the L-shaped bracket. When the lock is locked, the locking balls protrude from the shank, and extraction of the lock is prevented by contact between the balls and the L-shaped bracket. Opening of the meter box door is prevented by contact between the bottom of the bushing counter bore and the lock head.

The position of the L-bracket relative to the door hole is critical to the function of the locking assembly. Such precise positioning is difficult to achieve in field installations. Furthermore, the bracket is not adjustable once attached. Field installation of the prior art locking system is further complicated by the bottom or side wall position of the bracket, which makes it difficult to drill the anchor holes necessary to mount the bracket. Problems can also arise when using this assembly with barrel locks which are unlocked by rotation of the key. These locks, called rotationally actuated barrel locks, sometimes tend to rotate with the key, making it necessary to hold the lock case when unlocking the lock. The bushing in the prior art locking assembly completely covers the barrel lock case, thus preventing the user from holding the case. Whatever the precise merits, features and advantages of the above cited reference, none of them achieves or fulfills the objects of the present invention as set forth below.

SUMMARY OF THE INVENTION

Objects of the Invention

Accordingly, several objects and advantages of my invention are:

(a) To provide an adjustable door closure for an electric meter box.

(b) To provide a door closure for an electric meter box which can be easily used with rotationally actuated barrel locks.

(c) To provide an adjustable door closure for an electric meter box which is inexpensive to manufacture.

(d) To provide an adjustable door closure for an electric meter box which is easy to install.

(e) To provide a flanged barrel lock for use with meter box door closures.

Brief Physical Description

The preferred embodiment of the present invention is a door closure for a meter box, and includes a barrel lock with an external case. The case has an upper head portion and a smaller diameter lower shank portion which houses two retractable locking balls. The lock case also includes a flange and a ferrule portion with apertures for receiving a security seal. The lock head resides in a hole in the door of the meter box, and the flange abuts the outside surface of the door. The lock shank is received by a hole in one end of a cylindrical member called the lock receiver. This hole also has an internal groove on its circumference for receiving the locking balls when they are extended. The other end of the lock receiver contains a tapped hole, which receives the threaded end of a bolt like member called the tie rod. The other end of the tie rod is welded to a base plate, which is screwed into the back of the meter box during installation. Once the base plate and tie rod are in place, the position of the lock receiver can be adjusted to match the depth of the meter box by screwing the receiver up or down on the tie rod. The position of the receiver is then fixed by a lock nut immediately behind the lock receiver. The lock receiver can also be aligned with the door hole by flexing the tie rod.

Present Invention vs. Prior Art

The door closure of the present invention is easier to install than that of the prior art because it is attached to the back of the meter box, which is more accessible for drilling anchor holes than the bottom or side walls. The L-shaped bracket of the prior art is mounted on the bottom or side wall. Also, the adjustable nature of the present invention makes absolute positioning of the assembly during installation non-critical. The L-shaped bracket of the prior art must be precisely positioned for the assembly to lock properly and to minimize freeplay in the assembly when locked. Also, the present invention does not require the installation of a separate bushing in the door of the meter box.

The present invention is easier to use with rotationally actuated barrel locks than the prior art. The flange and ferrule portions of the bushing in the prior art prevent access to the lock case. The flange and the ferrule of the present invention are non-separable parts of the case, and are readily accessible for holding by the user. Including the flange and the ferrule as non-separable parts of the lock case in the present invention eliminates the bushing and the lock nut from the assembly. This reduces the part count and makes the present invention less expensive to manufacture and easier to install.

How the Present Invention Fulfills the Objects

In the present invention, the threaded connection between the tie rod and the lock receiver allows the assembly to be adjusted for variations in meter box depth. The flexibility of the tie rod in the present invention allows the final alignment of the lock receiver with the door hole to be adjusted after the base plate is in place. This makes installation quick and easy, since the location of the base plate is less critical. Inclusion of the flange and the ferrule as part of the lock case allows the user to hold the lock case during actuation of the lock. This makes it easier to use a rotationally actuated barrel lock with this assembly. The present invention incorporates a small number of simply designed components, making the overall invention light weight and inexpensive to manufacture. A critical feature in simplifying the overall design is the inclusion of the flange and the ferrule as non-separable parts of the lock case. This eliminates both the bushing and the locking nut from the assembly.

DETAILED DESCRIPTION OF THE PREFERRED EMBODIMENT

Figure 1:
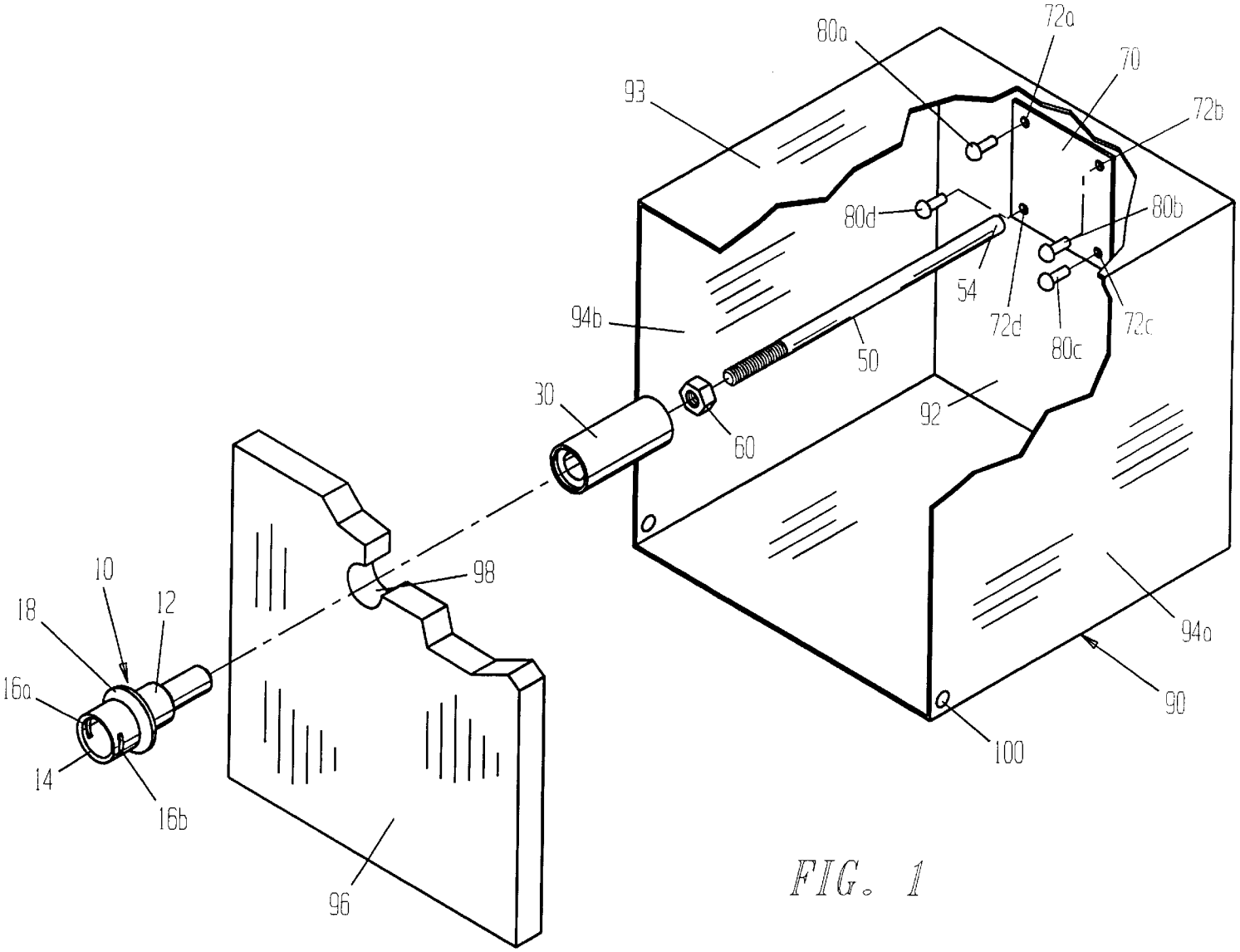
FIG. 1 shows an exploded isometric view of the preferred embodiment door closure and the meter box.
Figure 3:
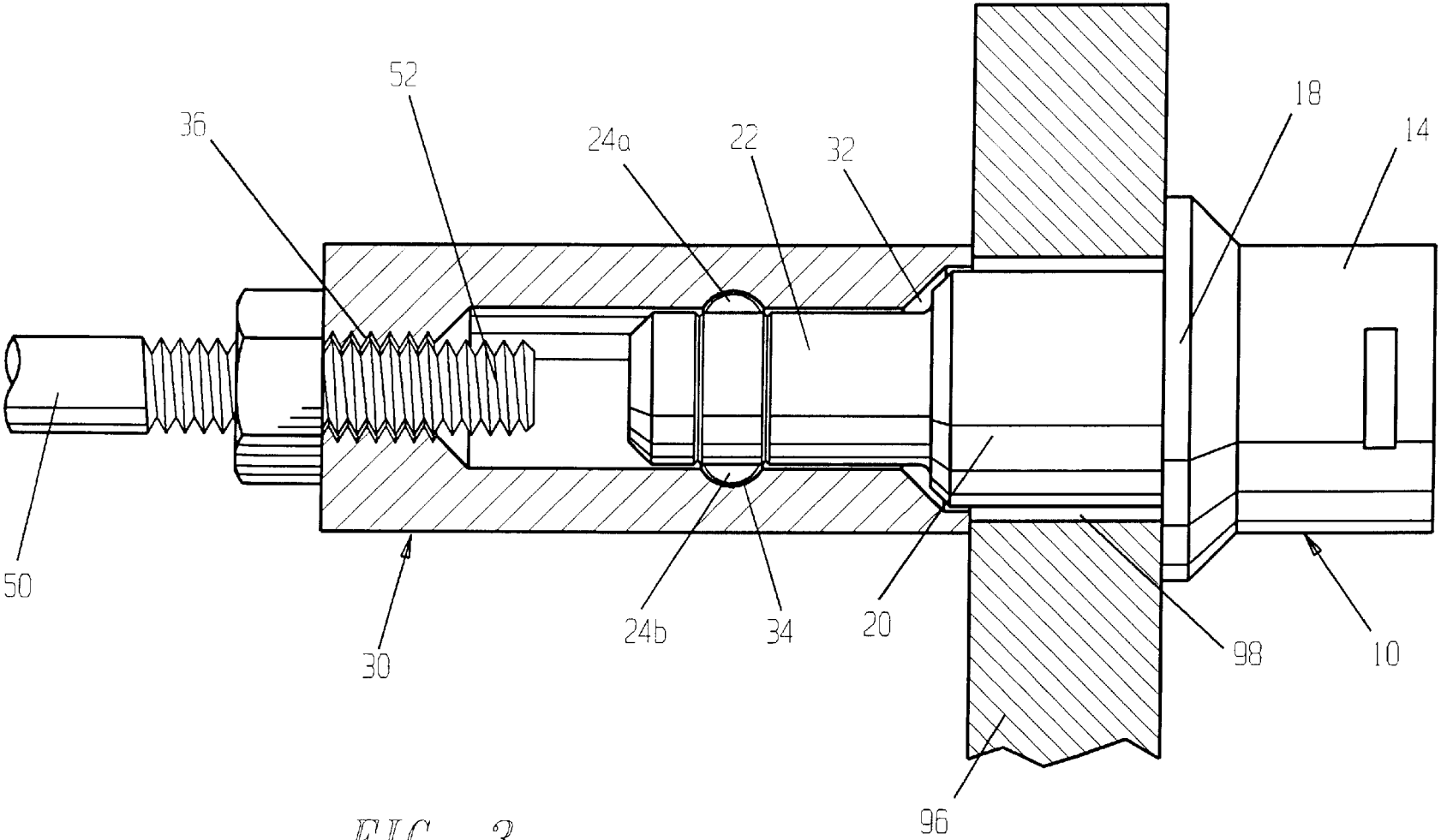
FIG. 3 shows a close up side view in partial section of the preferred embodiment door closure.

Referring to FIG. 1, the preferred embodiment of the present invention includes the barrel lock 10, lock receiver 30, tie rod 50, locking nut 60, base plate 70, and screws 80*a* through 80*d*. These components are used to secure the meter box 90, which has a back wall 92, top wall 93, side walls 94*a* and 94*b*, and a door 96 with an aperture or hole 98. The door is hinged at 100. The term meter box in the present disclosure is used to refer to any base structure relative to which the position of the door is to be controlled. The external case 12 of the barrel lock 10 includes a ferrule portion 14 with apertures 16*a* and 16*b* for receiving a security seal, and a flange 18 immediately below the ferrule portion. Referring to FIG. 3, adjacent to the flange 18 is a head portion 20 which houses a locking mechanism similar to the one described in U.S. Pat. No. 4,742,703. Below the head portion is a smaller diameter shank portion 22 which houses a locking means comprising two retractable locking balls 24*a* and 24*b*, which protrude from the shank when the lock is locked.

When the lock 10 is used to secure the meter box door 96, the head portion 20 of the lock resides in hole 98 of the door. The flange 18 acts as an obstructing means, being shaped so as to prevent passage of the lock 10 through the door hole. The lock receiving member or lock receiver 30 is generally cylindrical, and has a hole 32 in one end which receives the lock shank 22. This hole also has an internal groove 34 on its circumference which acts as a means for engaging the locking balls 24*a* and 24*b*. The lock receiver is connected to the meter box by an adjustable attachment means, which comprises a tapped hole 36, which receives the threaded end 52 of a flexible member or tie rod 50. Referring to FIG. 1, the far end 54 of the tie rod is welded to the center of the base plate 70. The base plate is a generally square, flat member which is attached to the back wall 92 of the meter box during installation via screw holes 72*a* through 72*d* and screws 80*a* through 80*d*.

Figure 2:
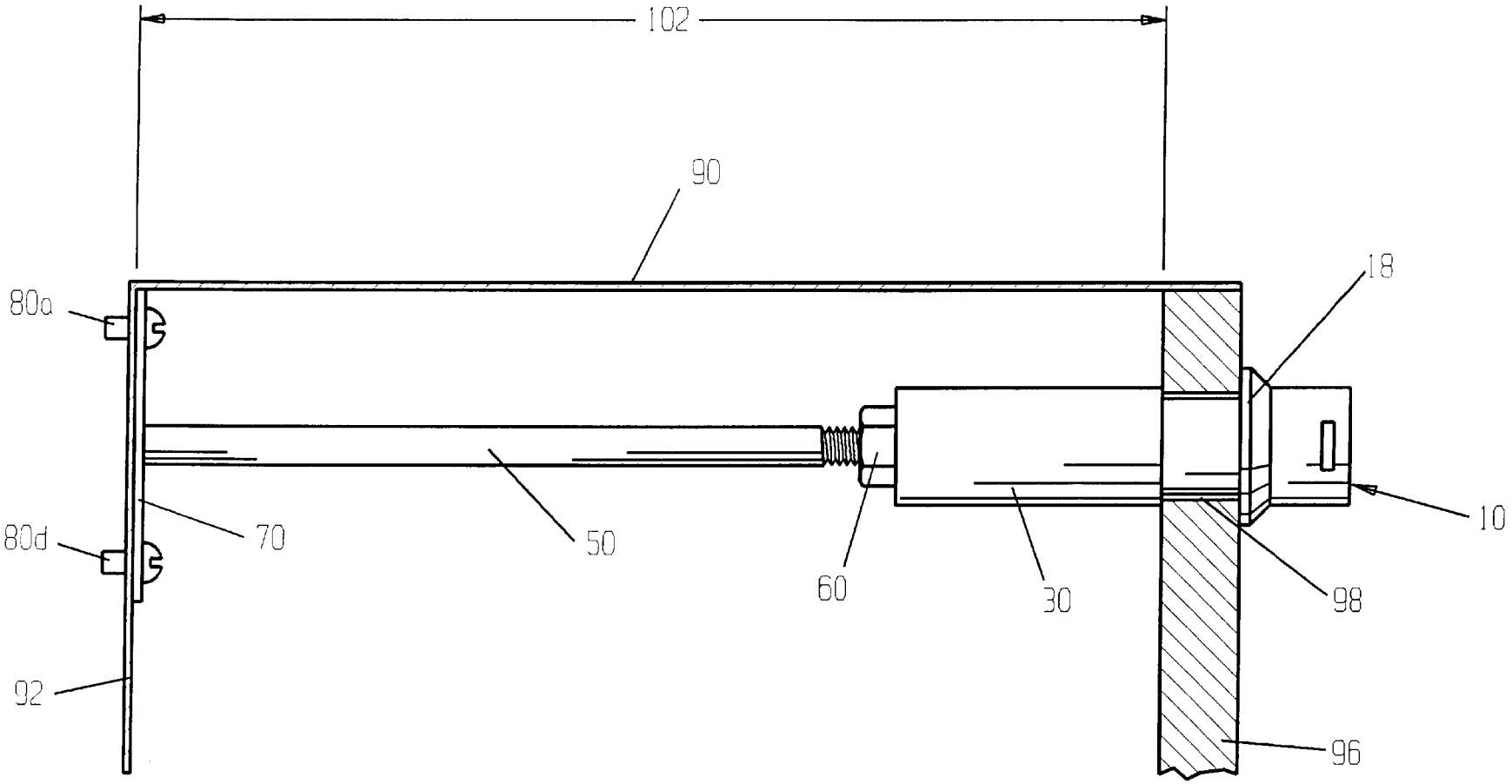
FIG. 2 shows a side view of the preferred embodiment door closure installed in the meter box, shown in partial section.

Referring to FIG. 2, once the base plate 70 is attached to the meter box 90, the position of the lock receiver 30 can be adjusted to match the depth 102 of the meter box by screwing the receiver up or down on the tie rod 50. The position of the lock receiver is then fixed by lock nut 60 immediately behind the lock receiver. The lock receiver 30 can be aligned with the door hole 98 in the door 96 by flexing the tie rod 50. Referring to FIG. 3, when the door 96 is closed, the lock receiver 30 acts as a stop for the door, providing proper alignment of the door with the meter box. The lock 10 is then inserted through the door hole and into the front hole 32 in the lock receiver 30. The ferrule portion 14 of the lock is held by the user, if necessary, and the lock is locked. The locking balls 24*a* and 24*b* now protrude into the internal groove 34 of the lock receiver. Referring to FIG. 2, if someone attempts to open the meter box door, the door will exert a force on the flange 18 on the lock 10. This force will be transmitted from the lock to the lock receiver 30, and then through the tie rod 50, base plate 70, and screws 80*a* through 80*d* to the back wall 92 of the meter box.

Alternative Embodiments

Figure 7:
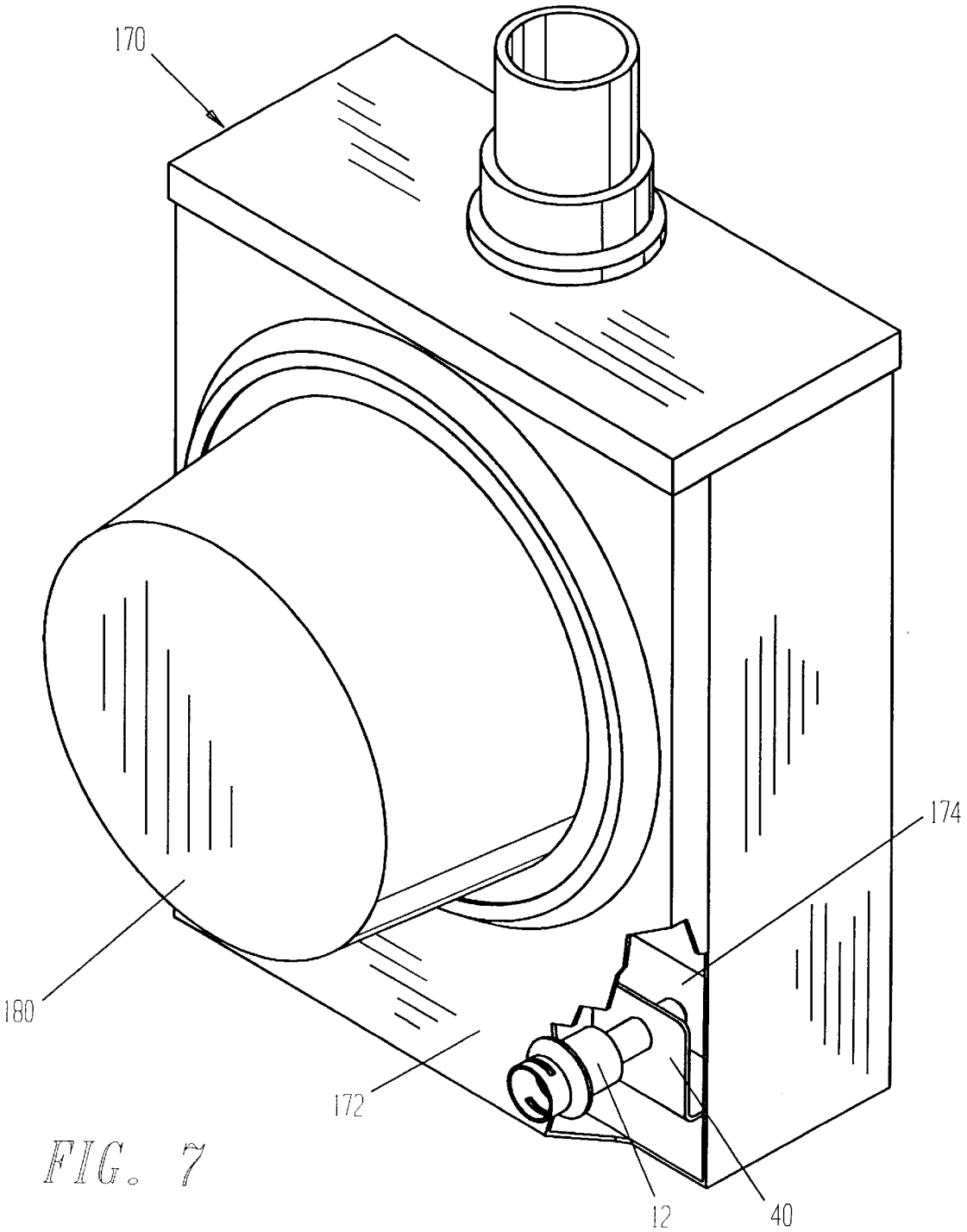
FIG. 7 shows an isometric cutaway view of the preferred embodiment barrel lock engaging the L-shaped bracket of the prior art to secure a ringless meter socket.
Figure 8:
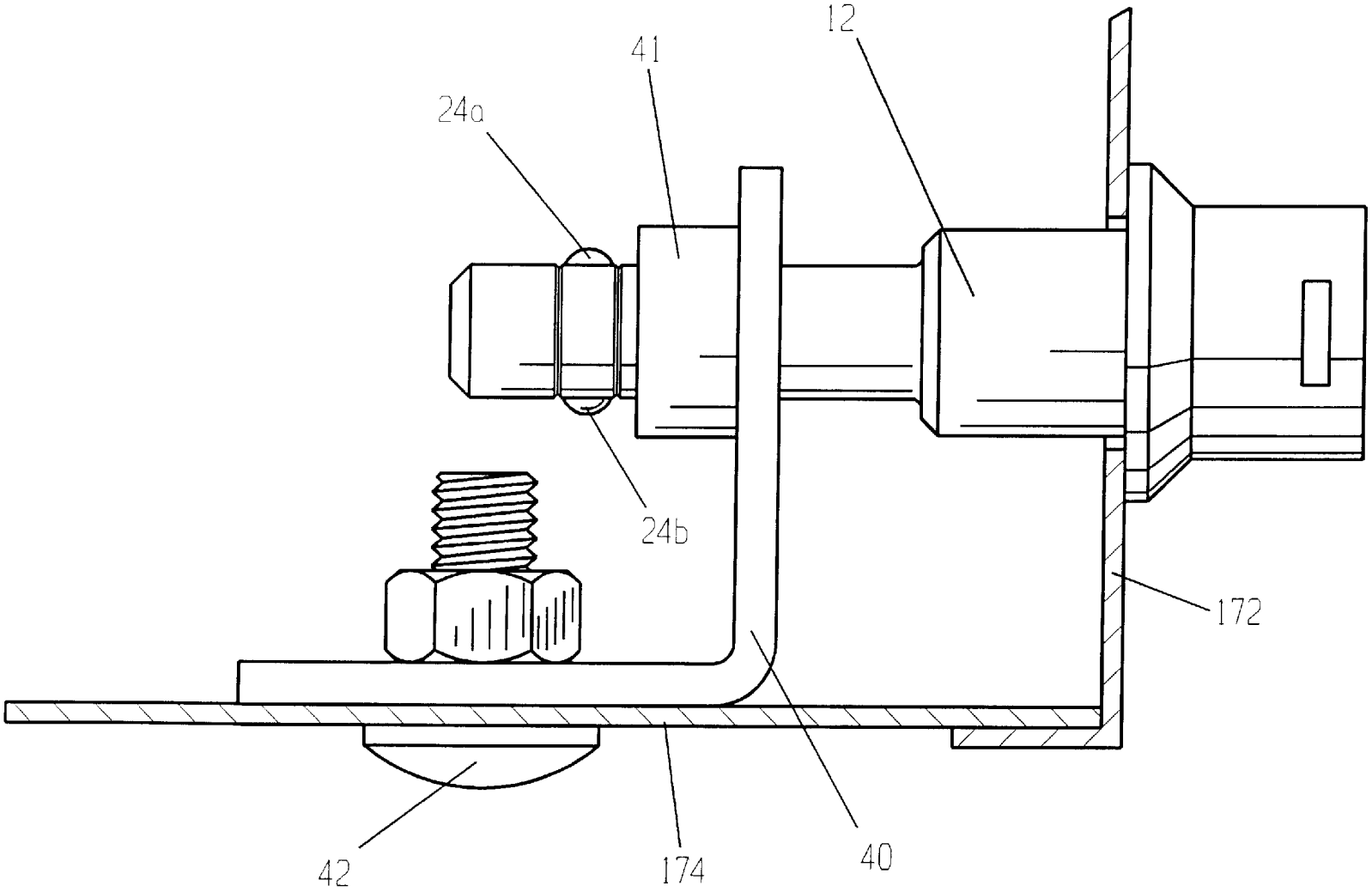
FIG. 8 shows a side view in partial section of the preferred embodiment barrel lock engaging the L-shaped bracket of the prior art.

In alternative embodiments, the barrel lock of the present invention can be used to secure any type of enclosure having a door. FIGS. 7 and 8 show an alternative embodiment door closure in which the preferred embodiment lock case 12 engages the L-shaped bracket 40 of the prior art. The bracket is mounted in a particular type of meter box 170 called a ringless meter socket. In this type of enclosure, the door 172 of the meter box retains the meter 180 in its socket in a manner well known in the industry. Referring to FIG. 8, the lock case 12 passes through the bracket 40. A bushing 41 is attached to the bracket 40 and engages the locking balls 24*a* and 24*b* to retain the lock. The bracket is attached to the wall 174 of the meter box 170 by a screw 42.

Figure 4:
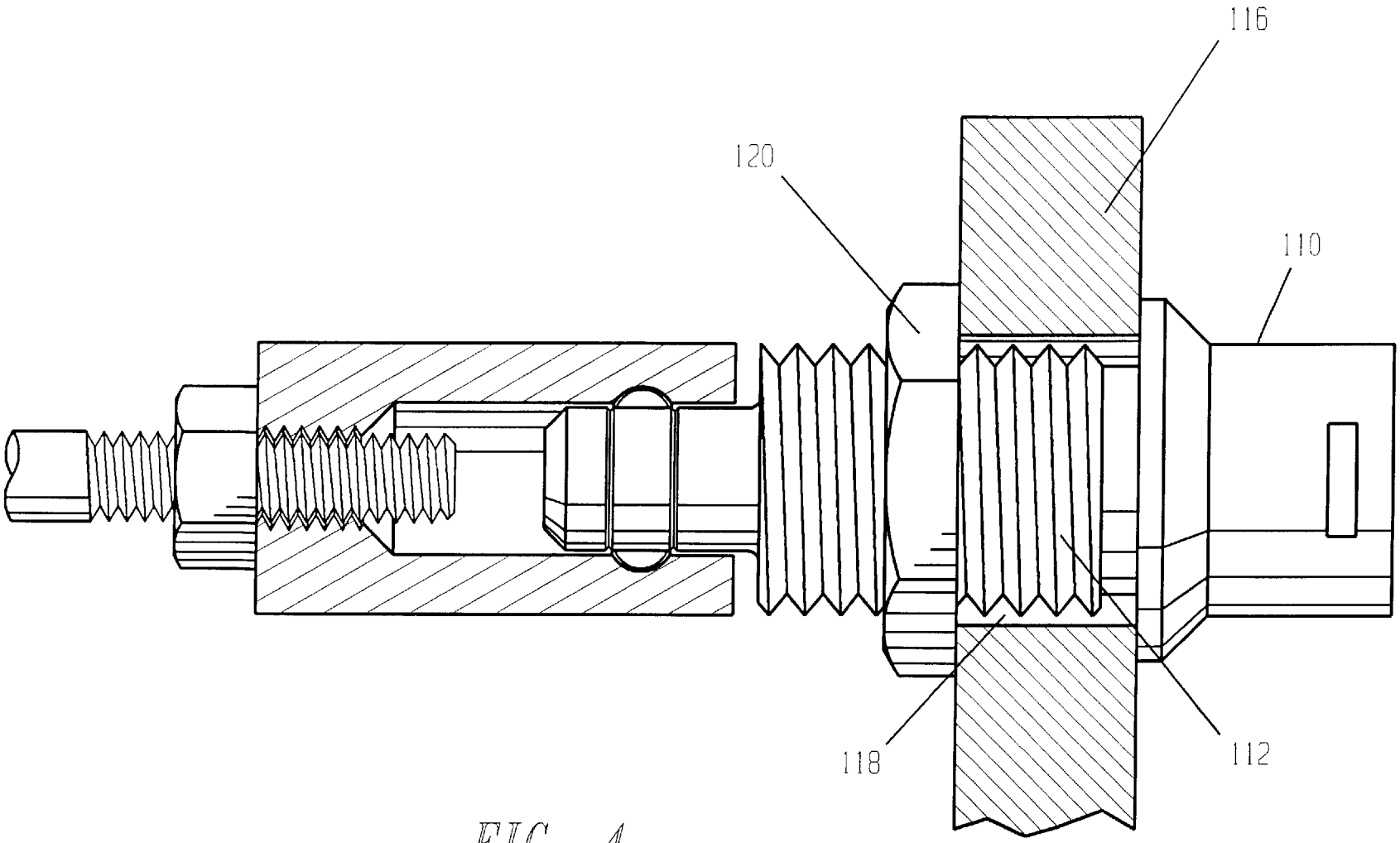
FIG. 4 shows a close up side view in partial section of an alternative embodiment in which the lock case is threaded and attached to the door with a lock nut.

In alternative embodiments, the barrel lock could be fixed to the door by a coupling means. In one such embodiment, as shown in FIG. 4, this coupling means comprises threads on the head portion 112 of the lock case 110, and a lock nut

Figure 9:
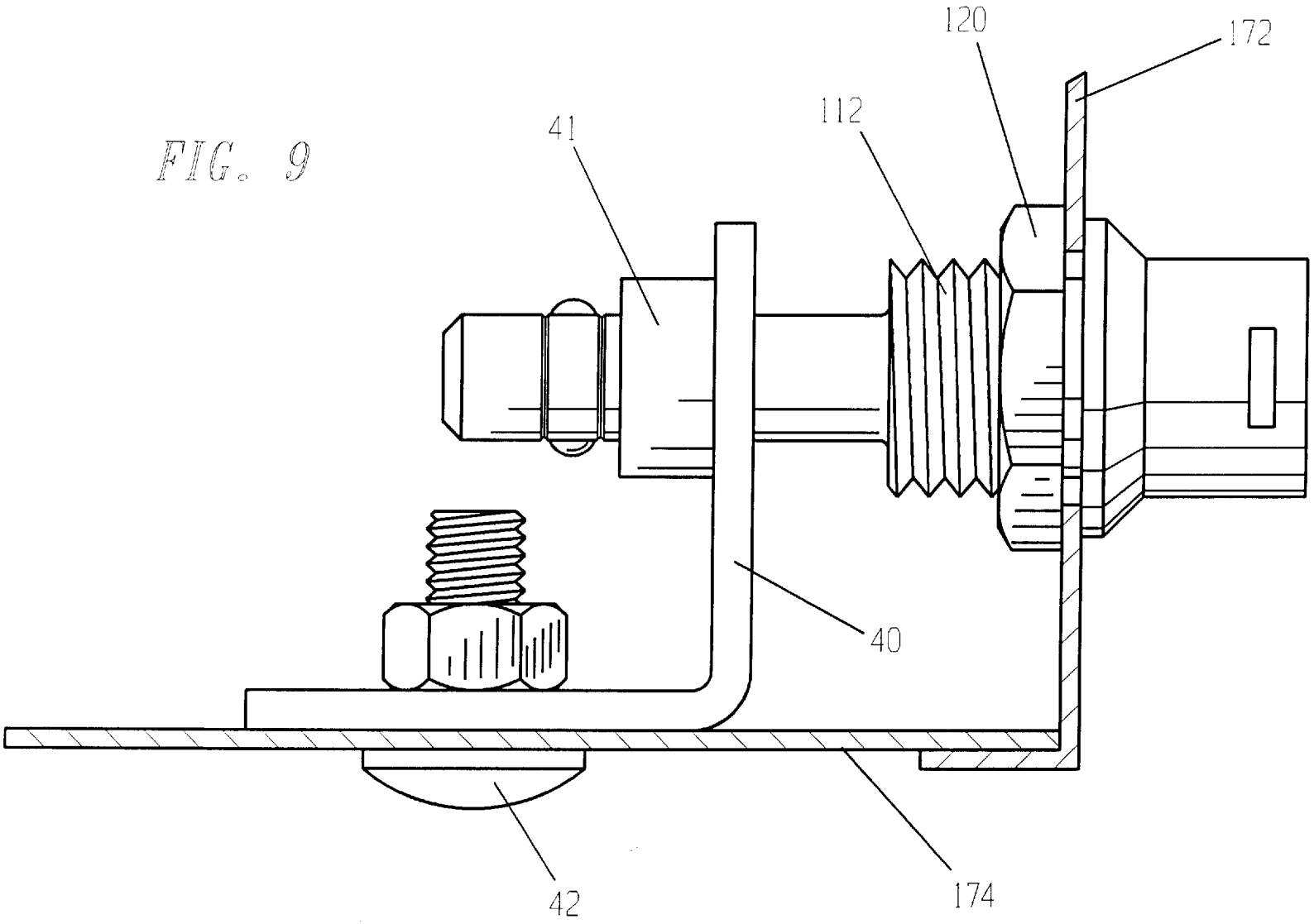
FIG. 9 shows a side view in partial section of an alternative embodiment threaded barrel lock engaging the L-shaped bracket of the prior art.

120, which is used to secure the lock case to the meter box door 116. FIG. 9 shows the threaded lock case 112 engaging the L-shaped bracket 40 of the prior art, with nut 120 securing the lock case to the door 172. A bushing 41 is attached to the bracket 40 and engages the locking balls to retain the lock. The bracket is attached to the wall 174 of the ringless meter socket by a screw 42.

Figure 5:
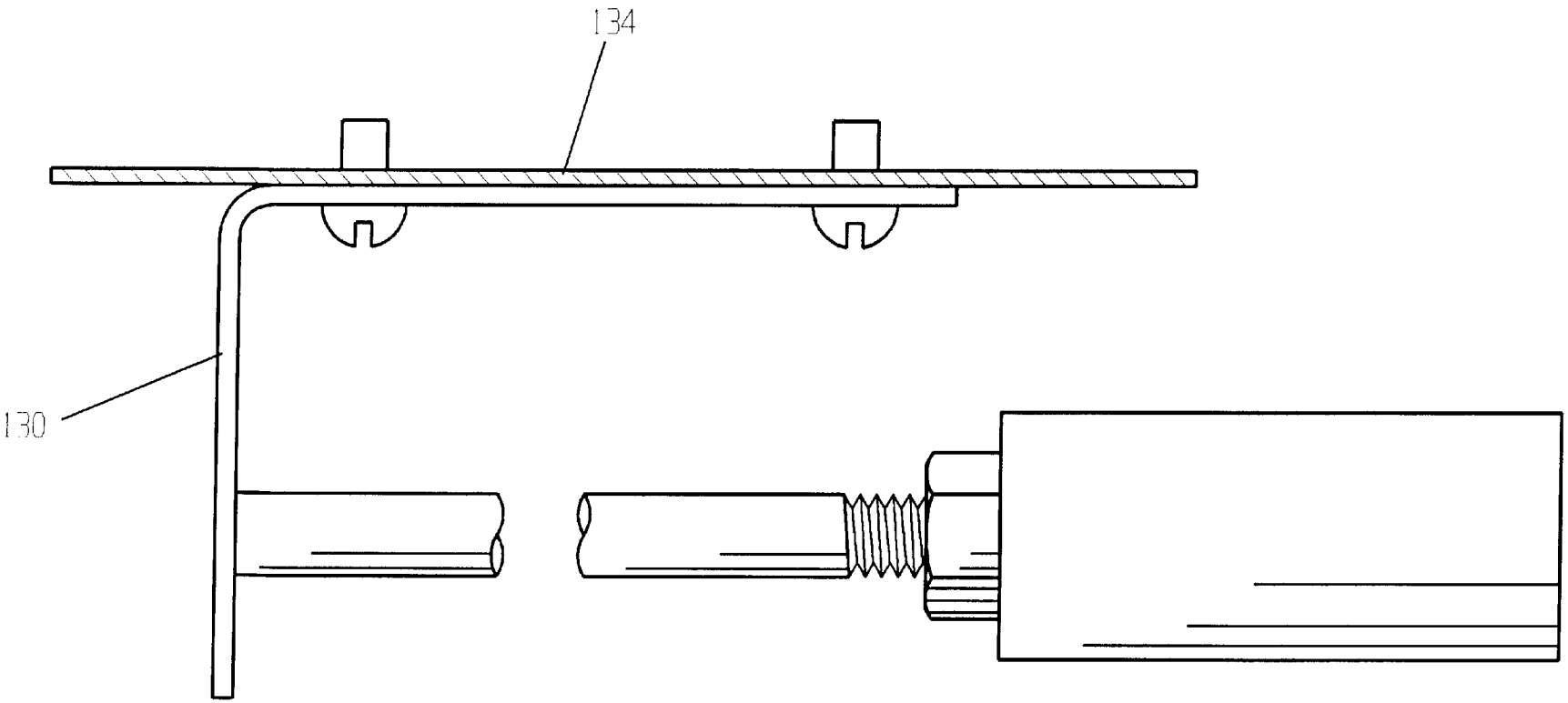
FIG. 5 shows a side view of an alternative embodiment in which the base plate is mounted to the top of the meter box, shown in section.

In other embodiments the door hole could be tapped and the threaded lock case screwed into the door. Also, the lock case could be attached to the door by more permanent means, such as welding, or the lock case could be formed from part of the door. In another alternative embodiment, as shown in FIG. 5, the base plate 130 has an L-shaped cross section, and is attached to the top wall 134 of the meter box. In other embodiments, the base plate could also be attached to one of the side walls of the meter box.

Figure 6:
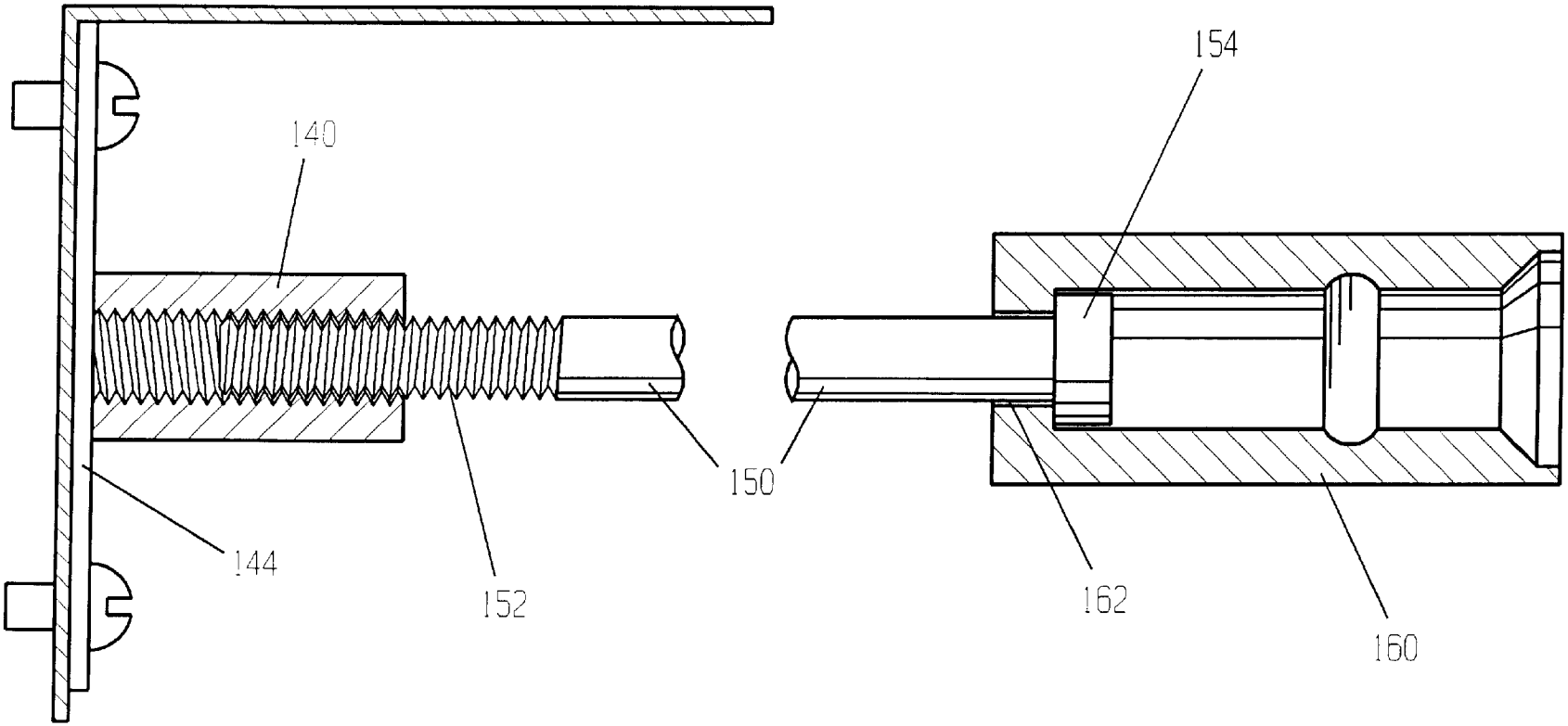
FIG. 6 shows a side view in partial section of an alternative embodiment in which the adjustment threads are at the opposite end of the tie rod, and are received by an internally threaded bushing, which is welded to the base plate.

In alternative embodiments, the adjustable attachment means between the lock receiver and the meter box could comprise a threaded connection interposed anywhere between these two members. FIG. 6 shows one such embodiment in which an internally threaded bushing 140 is attached to the base plate 144 by welding or other suitable means. The tie rod 150 is threaded on the far end 152, which is received by the bushing 140. The tie rod has a knob portion 154 at the end opposite the threaded end. The lock receiver 160 has a hole 162 at the end closest to the base plate 144. The diameter of this hole is smaller than the diameter of the head portion 154 of the tie rod 150. When installed, the knob portion of the tie rod resides in the lock receiver 160, and is captured by the hole 162. Adjustments for meter box depth are made by screwing the tie rod 150 in or out of the bushing 140. In other embodiments, the tie rod and the lock receiver could be machined as a single piece.

Conclusions, Ramifications, and Scope of the Invention

The present invention is well adapted to carry out the objects and attain the ends and advantages mentioned, as well as others inherent therein. The threaded connection between the tie rod and the lock receiver allows the position of the lock receiver to be adjusted for variations in meter box depth. The flexibility of the tie rod in the present invention allows the final alignment of the lock receiver with the door hole to be adjusted after the base plate is in place. This makes installation quick and easy, since the location of the base plate is less critical. Inclusion of the flange and the ferrule as part of the lock case allows the user to hold the lock case during actuation of the lock. This makes it easier to use a rotationally actuated barrel lock with this assembly. The present invention incorporates a small number of simply designed components, making the overall invention light weight and inexpensive to manufacture. A critical feature in simplifying the overall design is the inclusion of the flange and the ferrule as part of the lock case. This eliminates both the bushing and the locking nut from the assembly, as compared to the prior art. While, for the purposes of disclosure there have been shown and described what are considered at present to be the preferred embodiments of the present invention, it will be appreciated by those skilled in the art that other uses may be resorted to and changes may be made to the details of construction, combination of shapes, size or arrangement of the parts, or other characteristics without departing from the spirit and scope of the invention. It is therefore desired that the invention not be limited to these embodiments and it is intended that the appended claims cover all such modifications as fall within the true spirit and scope of the invention.

What is claimed is:

1. A door closure for retaining a door in a prescribed position relative to a base structure, said door defining a plane and having an aperture therethrough, said door closure comprising:

(a) a barrel lock for residing partially in said aperture in said door and oriented generally perpendicularly to the plane of said door, said barrel lock comprising:
  (i) a generally cylindrical external case having a head portion and a smaller diameter shank portion;
  (ii) locking means retractably extending outwardly from said shank portion; and
  (iii) a flange on said head portion of said external case, said flange being shaped so as to prevent passage of said barrel lock through said aperture in said door;

(b) a lock receiving member having engaging means for engaging said locking means of said barrel lock; and (c) attaching means for attaching said lock receiving member to said base structure, said attaching means being mountable to said base structure, said attaching means comprising:
  (i) a first adjusting means for adjusting the position of said lock receiving member along a line generally perpendicular to the plane of said door without remounting said attaching means, and
  (ii) a second adjusting means comprising an elongate flexible member having first and second ends, said first end being attached to said lock receiving member and said second end being adapted for mounting on said base structure, said flexible member being configured such that flexure of said flexible member results in movement of said lock receiving member generally in the plane of said door.

2. The door closure of claim 1 wherein said first adjusting means includes at least one threaded connection configured such that rotation of said lock receiving member about a line generally perpendicular to the plane of said door results in movement of said lock receiving member along said perpendicular line.

3. The door closure of claim 2 wherein:

(a) said lock receiving member is generally elongate and includes a lock receiving hole in one end for receiving said shank portion of said barrel lock, an internal groove in said lock receiving hole for engaging said locking means on said barrel lock, and a tapped hole in the end generally opposite said lock receiving hole, and (b) said flexible member has screw threads at one end for engaging said tapped hole in said lock receiving member.

4. The door closure of claim 1 wherein said first adjusting means includes at least one threaded connection configured such that rotation of said flexible member about a line generally perpendicular to the plane of said door results in movement of said lock receiving member along said perpendicular line.

5. The door closure of claim 4 wherein:

(a) said lock receiving member is generally elongate and includes a lock receiving hole in one end for receiving said shank portion of said barrel lock, an internal groove in said lock receiving hole for engaging said locking means on said barrel lock, and a clearance hole smaller in diameter than said lock receiving hole, said clearance hole being disposed at the end of said lock receiving member generally opposite said lock receiving hole;

(b) said attaching means comprises an internally threaded bushing; and (c) said flexible member is inserted into said clearance hole in said lock receiving member, said flexible member including:
  (i) a knob at one end, said knob being larger than said clearance hole such that said lock receiving member is retained by said knob, and (ii) screw threads at the end generally opposite said knob for engaging said internally threaded bushing.

6. The door closure of claim 1, wherein said barrel lock further comprises a ferrule portion extending axially from said head portion, said ferrule portion having at least one seal aperture therethrough.

7. The door closure of claim 1, wherein said barrel lock further comprises external threads on said head portion.

8. The door closure of claim 6, wherein said barrel lock further comprises external threads on said head portion.

9. A barrel lock comprising:

(a) a generally cylindrical external case having:

(i) a head portion, (ii) a smaller diameter shank portion which is non-separable from said head portion, and (iii) a ferrule portion which is non-separable from said head portion, said ferrule portion extending axially from said head portion, and said ferrule portion having at least one seal aperture therethrough; and (b) locking means retractably extending outwardly from said shank portion.

10. A barrel lock comprising:

(a) a generally cylindrical external case having:

(i) a head portion, (ii) a smaller diameter shank portion which is non-separable from said head portion, and (iv) external threads which is non-separable from said head portion; and (c) locking means retractably extending outwardly from said shank portion.

11. The barrel lock of claim 9 wherein said external case further comprises external threads which are non-separable from said head portion.

12. A door closure for retaining a door in a prescribed position relative to a base structure, said door closure comprising:

(a) a barrel lock for residing partially in an aperture in said door, said barrel lock comprising:

(i) a generally cylindrical external case having a head portion, a smaller diameter shank portion which is non-separable from said head portion, and a ferrule portion which is non-separable from said head portion, said ferrule portion extending axially from said head portion, and said ferrule portion having at least one seal aperture therethrough; and (ii) locking means retractably extending outwardly from said shank portion; and (b) a bracket member having engaging means for engaging said locking means of said barrel lock, said bracket member being mountable to said base structure.

13. A door closure for retaining a door in a prescribed position relative to a base structure, said door closure comprising:

(a) a barrel lock for residing partially in an aperture in said door, said barrel lock comprising:

(i) a generally cylindrical external case having a head portion, a smaller diameter shank portion which is non-separable from said head portion, and external threads which are non-separable from said head portion; and (ii) locking means retractably extending outwardly from said shank portion; and (b) a bracket member having engaging means for engaging said locking means of said barrel lock, said bracket member being mountable to said base structure.

14. The door closure of claim 12, wherein said barrel lock further comprises external threads which are non-separable from said head portion.

* * * * *